US006527099B2

(12) United States Patent
Ostermeier et al.

(10) Patent No.: US 6,527,099 B2
(45) Date of Patent: Mar. 4, 2003

(54) BELT DRIVE BACK UP DEVICE FOR ESCALATOR DRIVE

(75) Inventors: Joerg Ostermeier, Bückeburg (DE); Helmut Meyer, Bückeburg (DE); Andreas Stuffel, Westfalica (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/194,151

(22) Filed: Jul. 12, 2002

(65) Prior Publication Data

US 2002/0179405 A1 Dec. 5, 2002

Related U.S. Application Data

(63) Continuation of application No. 09/776,475, filed on Feb. 2, 2001.

(51) Int. Cl.[7] ..... B66B 23/06
(52) U.S. Cl. ..... 198/330; 198/331
(58) Field of Search ..... 198/325, 327, 198/330, 331

(56) References Cited

U.S. PATENT DOCUMENTS

| | | | | |
|---|---|---|---|---|
| 3,499,340 A | | 3/1970 | Teranishi et al. | |
| 4,895,240 A | * | 1/1990 | Bruehl et al. | 198/331 |
| 5,160,009 A | | 11/1992 | Iyoda et al. | |
| 5,566,810 A | | 10/1996 | Meyer et al. | |
| 5,782,333 A | | 7/1998 | Pitts | |
| 5,819,910 A | | 10/1998 | Langer et al. | |
| 5,881,859 A | * | 3/1999 | Bianchi | 198/335 |
| 6,092,639 A | | 7/2000 | Reo | |
| 6,119,845 A | | 9/2000 | Song | |
| 6,273,235 B1 | | 8/2001 | Inoue | |
| 6,450,317 B1 | * | 9/2002 | Fargo et al. | 198/330 |
| 6,457,573 B1 | * | 10/2002 | Ostermeier et al. | 198/330 |

FOREIGN PATENT DOCUMENTS

| | | |
|---|---|---|
| EP | 0389336 A | 9/1990 |
| GB | 272016 A | 6/1927 |

* cited by examiner

*Primary Examiner*—Douglas Hess
(74) *Attorney, Agent, or Firm*—Carlson, Gaskey & Olds

(57) ABSTRACT

An escalator drive machine includes a motor output sheave which drives a drive belt along a closed look between the output sheave and a drive sprocket. The output sheave engages the drive belt with the step chain such that the step chain and attached tread plates are propelled from one landing to the other. The output sheave includes a first set of teeth and a second set of teeth. The first set of teeth is around the output sheave hub to engage a set of belt teeth extending from the drive belt. The second set of teeth is preferably located along a rim of the output sheave and is engageable with corresponding link teeth located along each link in the drive chain. The second set of teeth maintain their relationship with the corresponding link teeth due to the first set of teeth, however, there is no contact therebetween. However, should the drive belt fail or become disengaged, the second set of teeth engage the corresponding link teeth. The step chain and attached tread plates are thereby prevented from moving independently.

12 Claims, 2 Drawing Sheets

BELT DRIVE BACK UP DEVICE FOR ESCALATOR DRIVE

The present application is a continuation of U.S. patent application Ser. No. 09/776,475, filed Feb. 2, 2001.

BACKGROUND OF THE INVENTION

This invention relates to a passenger conveyor system, and more particularly to a drive machine that restrains movement of the escalator tread plates.

A typical passenger conveyor, such as an escalator or moving walk, includes a frame, balustrades with movable handrails, tread plates, a drive system and a step chain for propelling the tread plates. The frame includes a truss section on both left and right band sides of the frame. Each truss section has two end sections forming landings, connected by an inclined midsection. The upper landing usually houses the escalator drive system or machine positioned between the trusses.

The drive system of an escalator typically consists of a step chain, a step chain drive sprocket, an axle and a drive motor. The drive motor drives the drive sprocket which imparts motion to the step chain. The step chain travels a continuous, closed loop, running from one elevation to the other elevation, and back. The step chain thereby propels the tread plates from one landing to the other. As the step chain engages the metal drive sprocket teeth, there is metal to metal contact which can produce noise.

Recently, escalators drive systems have incorporated a drive belt which engages the drive sprocket and the step chain. By driving the step chain with the drive belt, much of the metal to metal contact is eliminated which thereby reduces the potential for noise. However, should the drive belt not be engaged, the drive sprocket is no longer engaged with the step chain. The step chain, and thus the tread plates may be free to move.

Accordingly, it is desirable to assure that the step chain and attached tread plates are prevented from free movement independent of drive belt engagement.

SUMMARY OF THE INVENTION

An escalator system designed according to this invention improves escalator operational safety by providing a drive sprocket which are engageable the drive chain independently of a belt drive.

The escalator system includes a motor output sheave connected to a drive motor through a gearbox. The motor output sheave drives a drive belt along a closed loop between the output sheave and an idler sprocket. The belt engages with the step chain such that the step chain and attached tread plates are propelled from one landing to the other.

The output sheave preferably includes a first set of teeth and a second set of teeth. The first set of teeth is around a hub to engage a set of belt teeth extending from the drive belt. The second set of teeth is preferably located along a rim of the output sheave and are directly offset from the first set of teeth. The second set of teeth is engageable with corresponding link teeth located along each link in the drive chain. The second set of teeth maintain their relationship with the corresponding link teeth due to the first set of teeth, however, there is no contact therebetween. There is, therefore, no metal to metal contact during normal operation of the system. However, should the drive belt fail or become disengaged, the second set of teeth engage the corresponding link teeth. The step chain and attached tread plates are thereby prevented from moving independently.

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
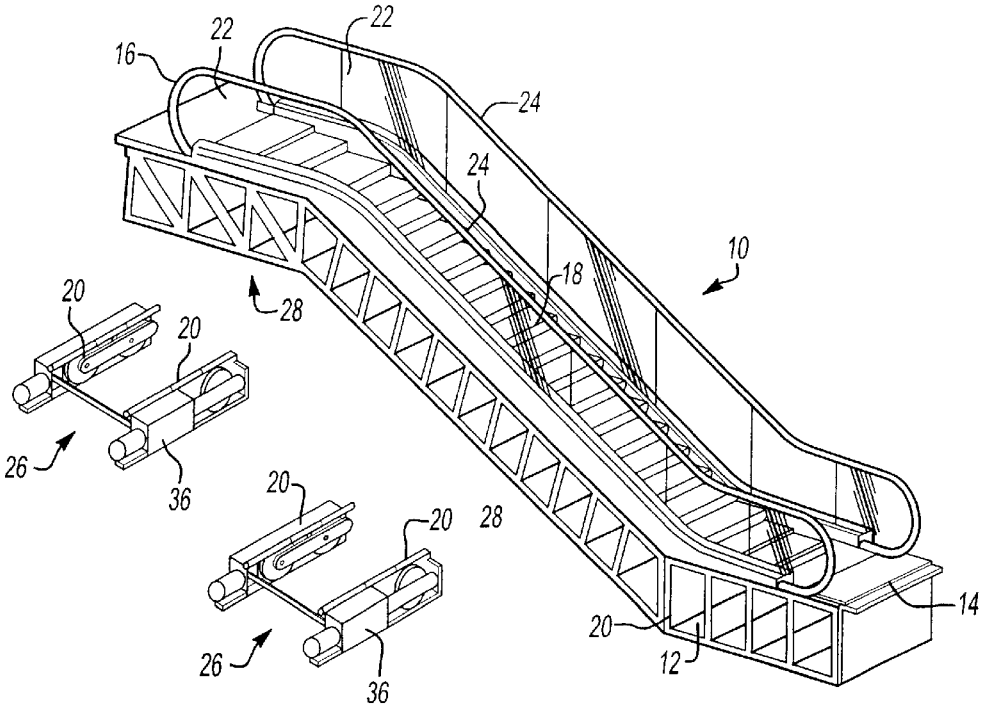
FIG. 1 is a perspective view of an escalator system.

FIG. 1 illustrates an escalator system 10. It should become apparent in the ensuing description that the invention is applicable to other passenger conveyors, such as moving walks. The escalator system 10 generally includes a support structure 12 extending between a lower landing 14 and an upper landing 16. A plurality of sequentially connected treadplates 18 are connected to a step chain 20 and travel through a closed loop path within the support structure 12. A pair of balustrades 22 include moving handrails 24. A machine 26 is typically located in a machine space 28 along the support structure 12. It should be realized that other machine locations will also benefit from the present invention. The drive machine 26 includes a drive motor and gearbox assembly 36. It should be realized that a plurality of machines 26 can be provided depending in part on the height of the escalator system 10.

Figure 2:
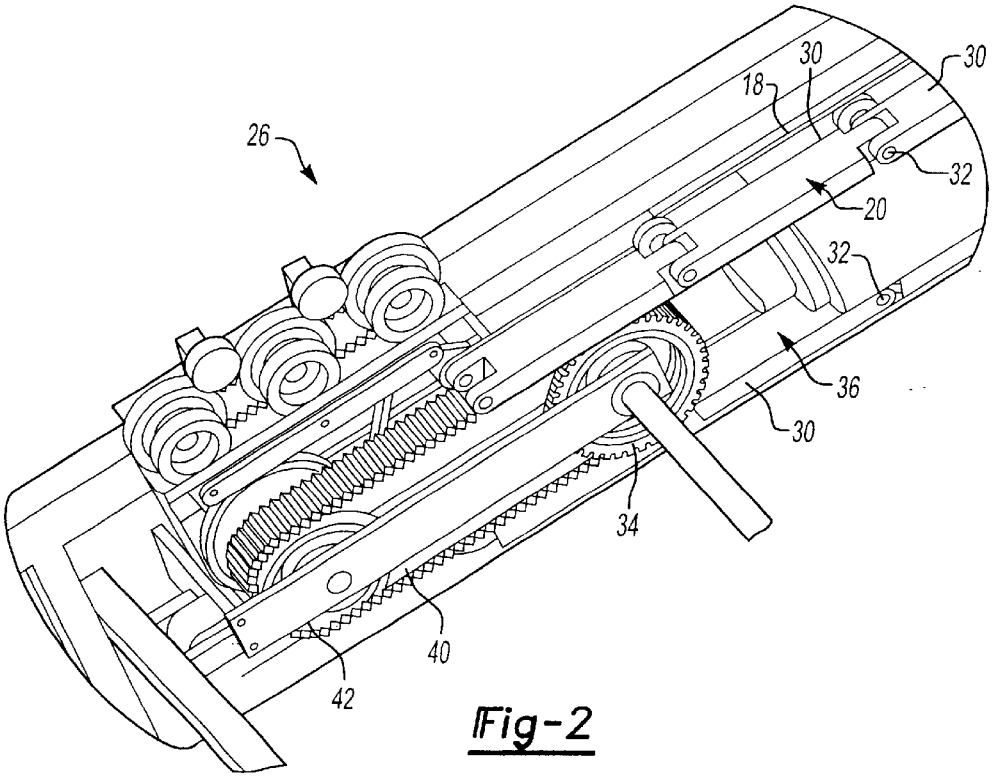
FIG. 2 is an expanded view of an escalator machine space.

Referring to FIG. 2, an expanded view of the machine 26 is illustrated. The tread plates 18 are pivotally attached to the step chain 20 and follow a closed loop path, running from one landing to the other, and back again. The step chain 20 includes a plurality of links 30 which are pivotally interconnected by a pin 32 located therebetween.

The drive motor and gearbox assembly 36 drives an output sheave 34. The motor and gearbox assembly 36 drives a drive belt 40 along a closed loop between the output sheave 34 and an idler sprocket 42. The drive belt engages with the step chain 20 such that the step chain 20 and attached tread plates 18 are propelled from one landing to the other.

Figure 3:
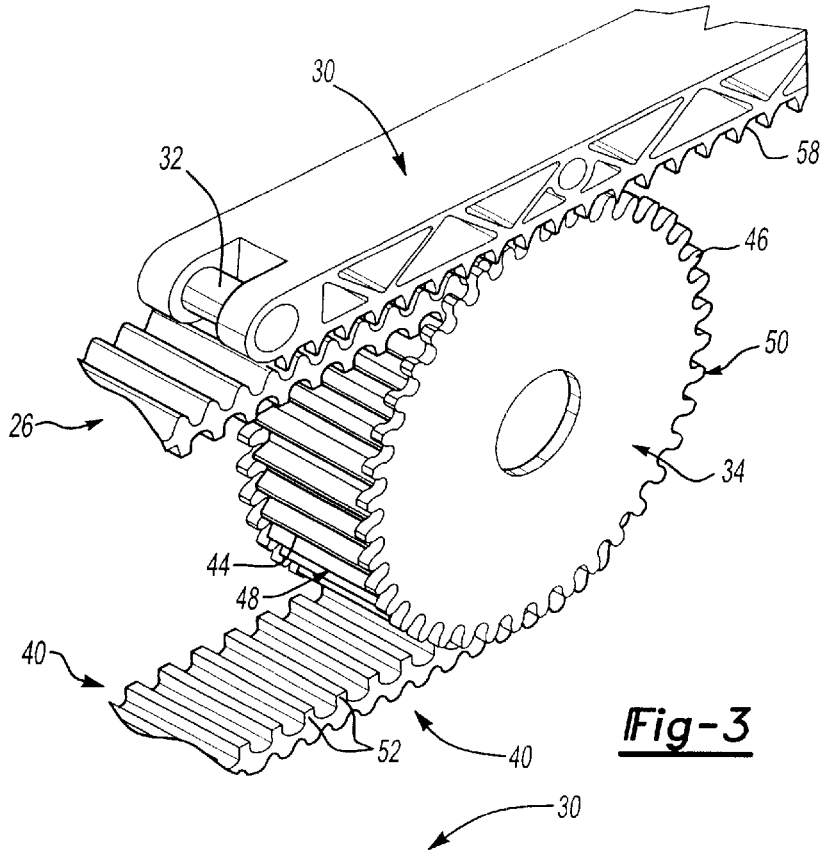
FIG. 3 is an expanded view of a drive belt engaged with links in a step chain.

Referring to FIG. 3, an exploded view of the link 30, drive belt 40 and output sheave 34 is illustrated. The drive belt 40 is engaged with the step chain 20 links 30 between the output sheave 34 and the idler sprocket 42.

The output sheave 34 includes a first set of teeth 44 and a second set of teeth 46. The first set of teeth 44 is preferably located around a hub 48 of the output sheave 34. The first set of teeth 44 engage a set of belt teeth 52 extending from the drive belt 40. Engagement between the belt teeth 52 and first set of teeth 44 assure that the drive belt 40 is driven with the minimum of slippage.

The second set of teeth 46 is preferably located along a rim 50 of the output sheave 34. The rim 50 is a radially extending flange which assists in retaining the drive belt 40 on the output sheave 34. The second set of teeth 46 is preferably directly offset from the first set of teeth 44. That is, each valley 54 in the second set of teeth 46 preferably corresponds with each peak 56 in the first set of teeth 44

Figure 4:
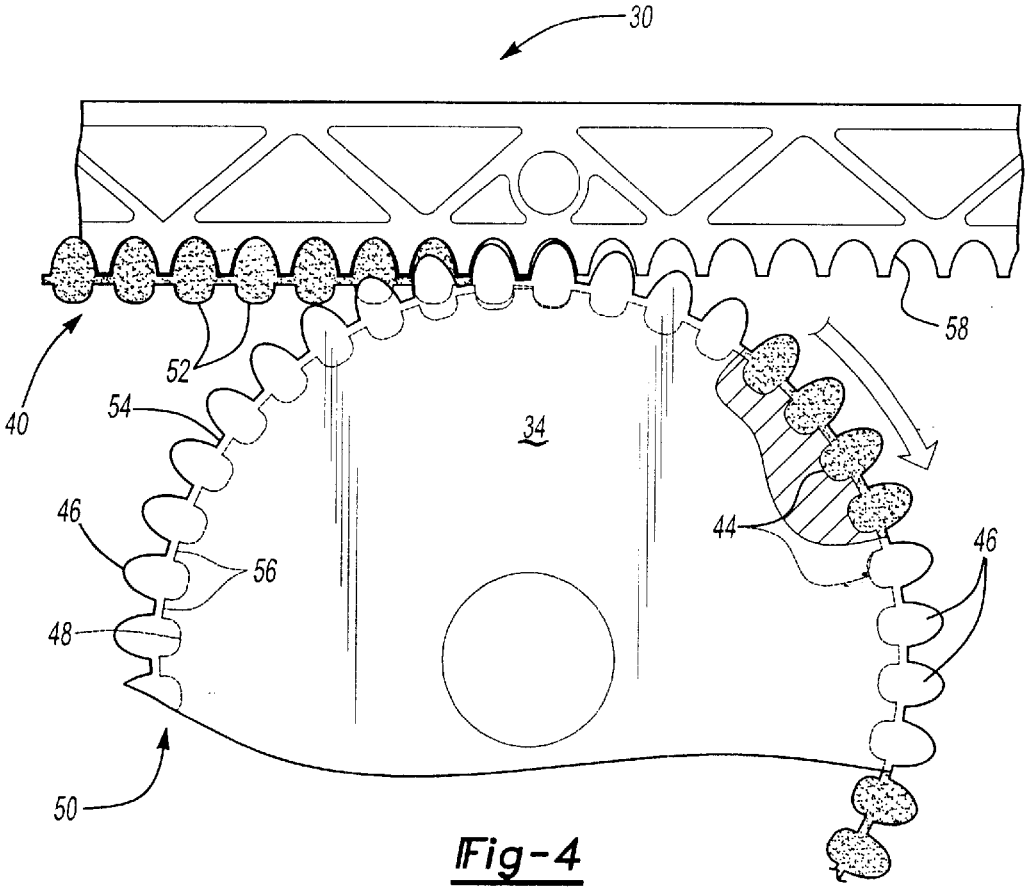
FIG. 4 is an expanded side view of the drive sprocket and and step chain illustrated in FIG. 3.

(FIG. 4). The second set of teeth 46 is engageable with corresponding link teeth 58 located along each link 30. Most preferably, the second set of teeth 46 do not contact the corresponding link teeth 58 when the drive belt 40 is in place. The second set of teeth 46 maintain their relationship with the corresponding link teeth 58 due to the first set of teeth 44 however, there is no contact therebetween. There is, therefore, no metal to metal contact during normal operation of the system 10. However, should the drive belt 40 fail or become disengaged, the second set of teeth 46 restrain motion of the corresponding link teeth 58. The step chain 20 and attached tread plates 18 (FIGS. 1 and 2) are thereby prevented from moving independently.

It should be realized that other belt engage arrangements will benefit from the present invention. Another belt drive arrangement is described in more detail in co-pending U.S. patent application Ser. No. 09/670,432 Filed Sep. 26, 2000, (Attorney Docket Number OT-4740 (60,469-026)) entitled "ESCALATOR DRIVE MACHINE" which is incorporated by reference in its entirety into this description. The present invention thereby provides a fail safe that assures that the tread plates can not move independently, due to belt disengagement. Moreover, the expense and mechanical complication of a separate mechanical brake can be avoided.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A passenger conveyer system comprising:

a plurality of tread plates connected by a step chain, said step chain comprising a plurality of links, each of said links having a plurality of link teeth;

a drive belt engaged with said plurality of link teeth; and an output sheave having a first set of teeth and a second set of teeth, said first set of teeth directly engaged with said drive belt such that said drive belt propels said plurality of tread plates, said second set of teeth engageable with said plurality of link teeth upon failure of said drive belt.

2. A passenger conveyer safety system as recited in claim 1, wherein said drive belt is located between said plurality of link teeth and said first set of teeth.

3. A passenger conveyer safety system as recited in claim 2, wherein said drive belt includes a first set of belt teeth which engage said plurality of link teeth and a second set of belt teeth which engage said first set of teeth.

4. A passenger conveyer safety system as recited in claim 3, wherein said first set of belt teeth are located on a first side of said belt and said second set of belt teeth are located upon an opposite side of said belt.

5. A passenger conveyer safety system as recited in claim 1, wherein said second set of teeth maintain a clearance between said plurality of link teeth.

6. A passenger conveyer safety system as recited in claim 1, wherein said second set of teeth are located along a rim extending from said drive sprocket.

7. A passenger conveyer safety system as recited in claim 6, wherein said rim is a radially extending flange.

8. A passenger conveyer safety system as recited in claim 1, wherein said drive belt is located between said plurality of link teeth and said first set of teeth.

9. A passenger conveyer system comprising:

a plurality of tread plates connected by a step chain, said step chain comprising a plurality of links, each of said links having a plurality of link teeth;

a drive belt having a first set of belt teeth opposite a second set of belt teeth, said first set of belt teeth engaged with said plurality of link teeth; and an output sheave having a first set of sheave teeth and a second set of sheave teeth, said first set of sheave teeth directly engaged with said second set of belt teeth such that said drive belt propels said plurality of tread plates, said second set of sheave teeth engageable with said plurality of link teeth upon failure of said drive belt.

10. A passenger conveyer safety system as recited in claim 9, wherein said drive belt is located between said plurality of link teeth and said first set of teeth.

11. A passenger conveyer safety system as recited in claim 9, wherein said second set of sheave teeth maintain a clearance between said plurality of link teeth.

12. A passenger conveyer safety system as recited in claim 9, wherein said second set of sheave teeth are located along a rim extending from said drive sprocket and said first set of sheave teeth are located along a hub of said drive sprocket.

* * * * *

UNITED STATES PATENT AND TRADEMARK OFFICE

CERTIFICATE OF CORRECTION

PATENT NO. : 6,527,099 B2
DATED : March 4, 2003
INVENTOR(S) : Ostermeier et al.

It is certified that error appears in the above-identified patent and that said Letters Patent is hereby corrected as shown below:

Title page,
Item [75], 3rd inventor's address should read as follows:

-- Andreas Stuffel, Porta Westfalica (DE) --

Signed and Sealed this

Twenty-ninth Day of July, 2003

JAMES E. ROGAN
*Director of the United States Patent and Trademark Office*